US008481836B2

(12) United States Patent
Pyon et al.

(10) Patent No.: US 8,481,836 B2
(45) Date of Patent: Jul. 9, 2013

(54) STRING DAMPENER FOR AN ELECTRIC OR ACOUSTIC STRINGED MUSICAL INSTRUMENT

(75) Inventors: William Young Pyon, Los Angeles, CA (US); Zoltan Nagy, Valley Village, CA (US)

(73) Assignee: Buznut U.S.A. LLC, Los Angeles, CA (US)

( * ) Notice: Subject to any disclaimer, the term of this patent is extended or adjusted under 35 U.S.C. 154(b) by 0 days.

(21) Appl. No.: 13/347,123

(22) Filed: Jan. 10, 2012

(65) Prior Publication Data

US 2012/0180615 A1 Jul. 19, 2012

Related U.S. Application Data

(60) Provisional application No. 61/461,474, filed on Jan. 19, 2011.

(51) Int. Cl.
*G10D 7/02* (2006.01)

(52) U.S. Cl.
USPC ..... 84/453

(58) Field of Classification Search
USPC ..... 84/453
See application file for complete search history.

(56) References Cited

U.S. PATENT DOCUMENTS

| | | | | | |
|---|---|---|---|---|---|
| 577,930 | A | * | 3/1897 | Prince | 84/318 |
| 1,518,935 | A | * | 12/1924 | Kozelek | 84/297 R |
| 2,628,524 | A | * | 2/1953 | Van Eps | 84/267 |
| 2,689,499 | A | * | 9/1954 | Shuman | 84/310 |
| 3,260,148 | A | * | 7/1966 | Fender | 84/267 |
| 3,427,916 | A | * | 2/1969 | Fender | 84/267 |
| 3,440,917 | A | * | 4/1969 | Lemon | 84/267 |
| 3,623,390 | A | * | 11/1971 | Pitt | 84/294 |
| 3,797,355 | A | * | 3/1974 | Law | 84/273 |
| 3,956,962 | A | * | 5/1976 | Fields | 84/267 |
| 3,971,287 | A | * | 7/1976 | Ito | 84/453 |
| 3,994,196 | A | * | 11/1976 | Hamil | 84/273 |
| 4,116,107 | A | * | 9/1978 | Rickard | 84/267 |
| D254,139 | S | * | 2/1980 | Rickard | D17/20 |
| 4,753,147 | A | * | 6/1988 | Berardi | 84/453 |
| 5,347,906 | A | * | 9/1994 | Geiger | 84/453 |

(Continued)

FOREIGN PATENT DOCUMENTS

| | | |
|---|---|---|
| GB | 2268612 A | 1/1994 |
| GB | 2481674 A | 1/2012 |

OTHER PUBLICATIONS

PCT Written Opinion of the International Searching Authority in Int. App. No. PCT/US2012/021925 dated Jun. 28, 2012.

(Continued)

*Primary Examiner* — David Warren
*Assistant Examiner* — Robert W Horn
(74) *Attorney, Agent, or Firm* — Patent Venture Group; Joe A. Brock, II

(57) ABSTRACT

An invention is afforded for a dampening apparatus for a musical instrument. The dampening apparatus includes a plurality of dampening pads disposed on a base element. The dampening pads are spaced to allow a string of a stringed musical instrument to fit between two dampening pads. In addition, at least one dampening pad is configured to fit between two strings of the stringed musical instrument to allow for free string vibration. The base element and the plurality of dampening pads are configured to fit between the strings and a fretboard of the stringed musical instrument.

16 Claims, 6 Drawing Sheets

U.S. PATENT DOCUMENTS

| | | | | |
|---|---|---|---|---|
| 5,467,679 | A * | 11/1995 | Schmidt | 84/312 R |
| 5,497,690 | A * | 3/1996 | Soupios | 84/453 |
| 5,569,863 | A * | 10/1996 | Lem | 84/312 R |
| 6,452,077 | B1 * | 9/2002 | Chapman et al. | 84/273 |
| 6,521,820 | B1 * | 2/2003 | Patel | 84/318 |
| 7,488,880 | B2 * | 2/2009 | Batio | 84/318 |
| 2006/0090627 | A1 * | 5/2006 | Reed | 84/319 |
| 2007/0209496 | A1 | 9/2007 | Lenzi | |
| 2012/0180615 | A1 * | 7/2012 | Pyon et al. | 84/297 S |

OTHER PUBLICATIONS

PCT International Search Report in Int. App. No. PCT/US2012/021925 dated Jun. 28, 2012.

* cited by examiner

STRING DAMPENER FOR AN ELECTRIC OR ACOUSTIC STRINGED MUSICAL INSTRUMENT

CROSS REFERENCE TO RELATED APPLICATIONS

This application claims the benefit of U.S. Provisional Patent Application having Ser. No. 61/461,474, filed on Jan. 19, 2011, by inventors Zoltan Nagy and William Young Pyon, and entitled "String Dampener for the Use in Conjunction with Playing an Electric or Acoustic Stringed Musical Instrument," which is hereby incorporated by reference.

BACKGROUND OF THE INVENTION

1. Field of the Invention

This invention relates generally to tools for string musical instruments, and more particularly to a string dampener to reduce unwanted or unpredictable sound from strings of musical instruments.

2. Description of the Related Art

Since the inception of the Guitar and Bass Guitar, there have been numerous inventions to help aid the instrumentalist in perfecting the art of playing, enhancing and maintaining the instrument. Stringed musical instruments produce noise through the vibration of taut, fastened strings. Especially when played by some action of plucking, fingering, strumming, or utilizing a bow, it is common for strings that have not been directly touched to resonate and release at least a low level of sound. This sonic phenomenon may also occur even in strings that have not been physically touched at all, such as in the act of striking a string, a technique called "hammering" amongst guitar players whereby the string is directly hit from above; when striking one string, it is possible for nearby strings or those that share a certain relationship in frequency to resonate as well, creating "sympathetic" tones or "overtones," unpredictable noises in addition those that already produced by the possible brushing of adjacent strings.

It is common knowledge among electric guitar and bass guitar players of learning certain playing techniques, which help to address the problem of eliminating unwanted noise and notes. The Palm Mute technique is the most common and used by electric Guitar and Bass players, in an attempt to produce a "cleaner" sound or a tone to the same effect, often compensate for such extraneous noise. The "palm mute" or "palm muting" uses the side of the palm of the picking hand closest to the body of the guitar that comes into direct contact with all or some strings, and in a certain degree of pressure, to subdue lesser sounds or produce a certain resulting effect and to produce a clean vibration of the note or notes being played and controlling only the strings and notes that are allowed to produce the desired sound. Another technique utilized for this purpose is using the fretting fingers to cover the strings and notes not being played without producing any unwanted noise or notes.

There have been devices already Patented for the purposes of trying to achieve the goal of eliminating unwanted extraneous noises in the pursuit of purifying all musical notes desired. However, there are limitations and flaws in the prior art. In general, most prior art devices hinder playability, require complicated attachments, and require undesired adjustments to the instrument. This has been a problem especially for electric Guitar and electric Bass Guitar Players from the time amplification had been introduced.

One known string dampener is U.S. Pat. No. 7,488,880, which attaches to the headstock of a guitar and requires an overarching extension, which clamps down from above. This invention for string dampening comes into contact with the strings several inches from the root of the attachment, such as after the first and second fret of a guitar, inhibiting access to the covered portion. This clearly hinders full access and range of the musical instrument. Another problem with this invention is that the user cannot play open chords, which generally are played on the first three frets of the guitar and utilize the effects of the dampener to eliminate extraneous unwanted string noise. The '880 reference also requires a considerable amount of setup to secure the apparatus in place and to adjust the overhead damping pressure. Such characteristics can damage the headstock of the instrument and are inconvenient.

Another string dampener or string mute device is U.S. Pat. No. 4,753,147, which dampens the strings by wrapping a dampening material around the neck of the instrument and adjusting the pressure of the dampening material from the top of the strings to produce the desired effect of eliminating unwanted string noise. However, there are some flaws with this invention as well. First, because the size of the diameter of the neck of the instrument changes from the first fret to the twelfth fret, an artist must adjust the device as they play in higher intervals further away from the nut of the neck for this device to be effective in eliminating unwanted string noise. Also, due to the fact that the device fits over the top of the strings on the instrument, the device hinders and gets in the way of access to the entire fretboard and all the notes of the instrument, thus prohibiting playing of notes from the first fret where most open chord voicing's are played.

In view of the forgoing, there is a need for an apparatus that allows the strings of a stringed musical instrument to be dampened and undampened easily, even during a live performance of the musical instrument. Moreover, the apparatus should allow access to the entire fretboard of the instrument without restriction.

SUMMARY OF THE INVENTION

Broadly speaking, embodiments of the present invention address these needs by providing a dampening apparatus that is inserted between the strings and the fretboard of a stringed musical instrument. Using dampening pads in conjunction with disengagement spaces between the dampening pads, the dampening apparatus of the embodiments of the present invention can be engaged for dampening and disengaged, allowing for free string vibration, easily even during a live performance with the musical instrument.

In one embodiment, a dampening apparatus for a musical instrument is disclosed. The dampening apparatus includes a plurality of dampening pads disposed on a base element. The dampening pads are spaced to allow a string of a stringed musical instrument to fit between two dampening pads. In addition, each dampening pad is configured to fit between two strings of the stringed musical instrument to allow for free string vibration, as described in greater detail in the detailed description of the embodiments of the present invention. As mentioned above, the base element and the plurality of dampening pads are configured to fit between the strings and the fretboard of the stringed musical instrument. In use, the plurality of dampening pads engages strings of the stringed musical instrument when placed in a first position (engaged position), such that the strings rest the dampening pads when engaged. The plurality of dampening pads disengage strings of the stringed musical instrument when placed in a second position (disengaged position), such that the strings rest between dampening pads when disengaged, thus allowing for free vibration of the strings.

A further dampening apparatus for a musical instrument is disclosed in an additional embodiment of the present invention. In this embodiment, the dampening apparatus includes a base element that has a tab at one end. As above, a plurality of dampening pads is disposed on the base element spaced to allow strings of a stringed musical instrument to fit between the dampening pads. Here, each dampening pad is configured to fit between two strings of the stringed musical instrument when the tab of the base element is positioned in contact with a fretboard of the stringed musical instrument. As mentioned above, the base element and the plurality of dampening pads are configured to fit between the strings and the fretboard of the stringed musical instrument. The dampening pads of the plurality of dampening pads are configured to dampen string vibrations, and can comprises for example felt. The base element can comprise a single strip of a soft plastic like substance.

A method for dampening strings of a stringed musical instrument is disclosed in a further embodiment of the present invention. The method includes inserting the dampening apparatus between the strings of a musical instrument and the fretboard of the musical instrument. Similar to above, the dampening apparatus includes a plurality of dampening pads spaced to allow a string of a stringed musical instrument to fit between two dampening pads. To allow for free vibration of the strings, the dampening apparatus is shifted such that each string rests within a space between two dampening pads of the dampening apparatus. To dampen the strings the dampening apparatus is shifted such that each string rests on a separate dampening pad of the dampening apparatus.

Advantageously, embodiments of the present invention are not permanently fixed to the fretboard of the instrument, and provide easy attachment and removal of the dampening apparatus when the player of the musical instrument chooses to do so, without damaging the instrument. Moreover, by being positioned beneath the strings of the musical instrument, embodiments of the present invention allow utilization of all the notes from the entire neck of the instrument without changing the effectiveness of dampening effect. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a dampening apparatus for use with a stringed musical instrument. The dampening apparatus provides access to the entire fretboard and can be engaged and disengaged while playing the instrument in a live situation. In general, the dampening apparatus of the embodiments of the present invention fits under the strings, between the strings and the fretboard, thus providing access to the entire fretboard. Moreover, the dampening pads of the present invention generally are configured to allow a string to fit between each pad, thus allowing the dampening apparatus to be easily disengaged, even while playing the instrument in a live situation.

In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

Figure 1:
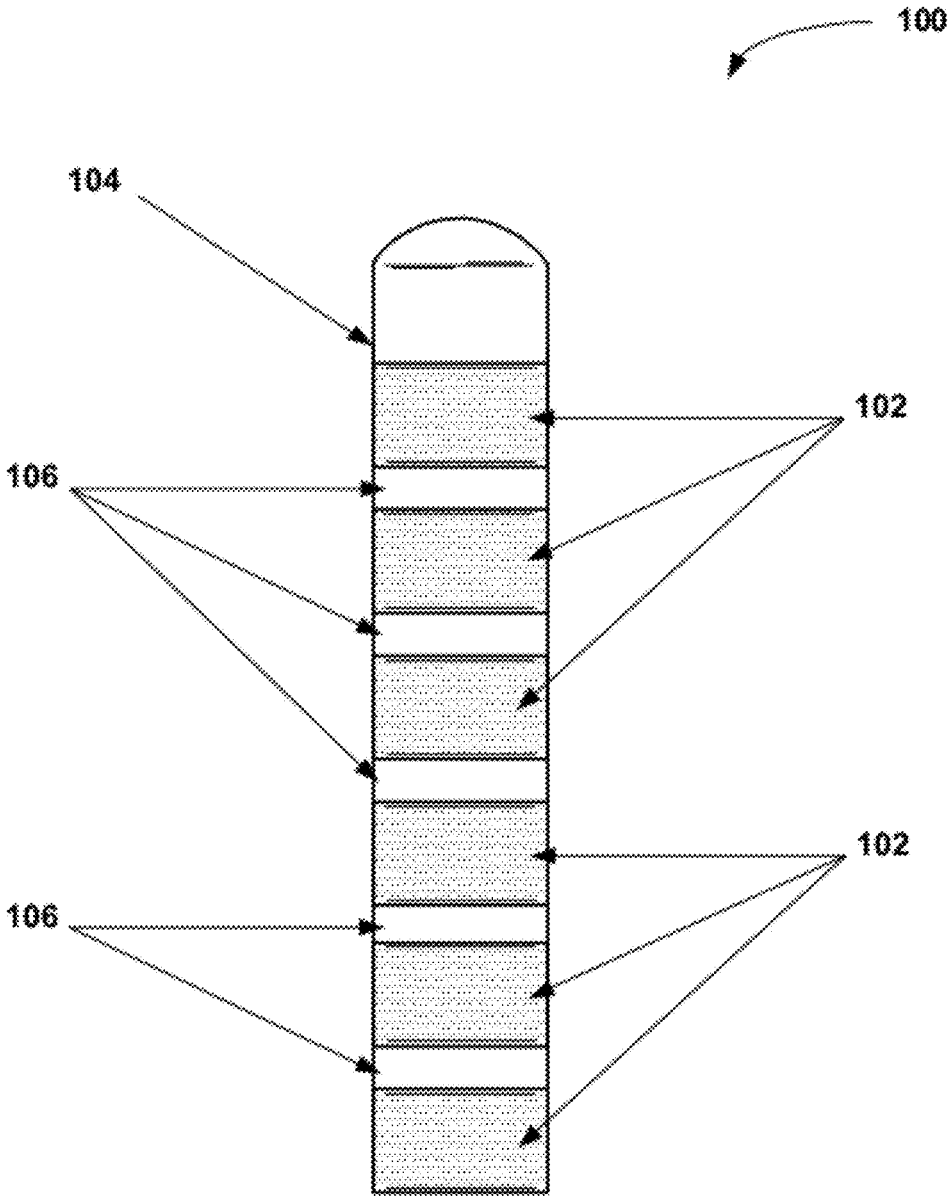
FIG. 1 is an illustration showing an exemplary dampening apparatus for use with a stringed musical instrument, in accordance with an embodiment of the present invention.

FIG. 1 is an illustration showing an exemplary dampening apparatus 100 for use with a stringed musical instrument, in accordance with an embodiment of the present invention. The exemplary dampening apparatus 100 includes a plurality of dampening pads 102 disposed on a base element 104. As shown in FIG. 1, the dampening pads 102 are configured on the base element 104 to allow for disengagement spaces 106 between the dampening pads 102. Each disengagement space 106 allows a string of a stringed musical instrument to be placed in between two dampening pads 102 to disengage the dampening effect, as described in greater detail subsequently. In addition, some or all of the dampening pads 102 are configured to fit between two strings of the stringed instrument to disengage the dampening effect. The dampening pads 102 are configured to dampen string vibrations when engaged with the strings of a stringed musical instrument, and can be manufactured from any material capable of string dampening, such as felt, form, rubber, fabric, or any other material capable of dampening string vibrations.

Although the exemplary dampening apparatus 100 illustrated in FIG. 1 includes six dampening pads 102, it should be noted that any number of dampening pads 102 may be included in embodiments of the present invention. The number of dampening pads 102 included in the dampening apparatus 100 varies depending on the instrument on which the dampening apparatus is to be used. For example, an embodiment for use with an electric guitar may include six or seven dampening pads 102, while an embodiment for use with a base guitar may include four or five dampening pads 102.

As will be described in greater detail subsequently, the dampening apparatus 100 of the embodiments of the present invention is configured to be placed between the strings and the fretboard and generally near the nut of the neck of the instrument. In this manner, when engaged, strings of the instrument are disposed on top of the dampening pads 102, thus dampening the vibrations of the strings. To disengage, the dampening apparatus 100 is shifted so that the strings of the instrument are placed within the disengagement spaces 106 formed between the dampening pads 102, thus allowing the strings to vibrate freely. As can be appreciated, pressure from the strings of the instrument hold the dampening apparatus 100 in place, whether engaged or disengaged, thus providing an efficient and more cost effective alternative to prior art string dampeners, which generally are permanently attached to the instrument and fit over the strings, denying access to frets near the nut on the fretboard.

Embodiments of the present invention can be comprised of different materials and be of various size dimensions and specifications, which rely on the specifications of the material, the size, and placement of the dampening apparatus onto the musical stringed instrument to maximize the effectiveness of dampening the strings. Advantageously, this is achieved without putting pressure from the top of the strings, which can cause buzzing and hinder the playability of the stringed instrument. That is, embodiments of the present invention allow utilization of all the notes from the entire neck of the instrument without changing the effectiveness of dampening while eliminating unwanted extraneous noise caused by sympathetic vibrations or un-dampening strings for longer sustained open notes.

Figure 2:
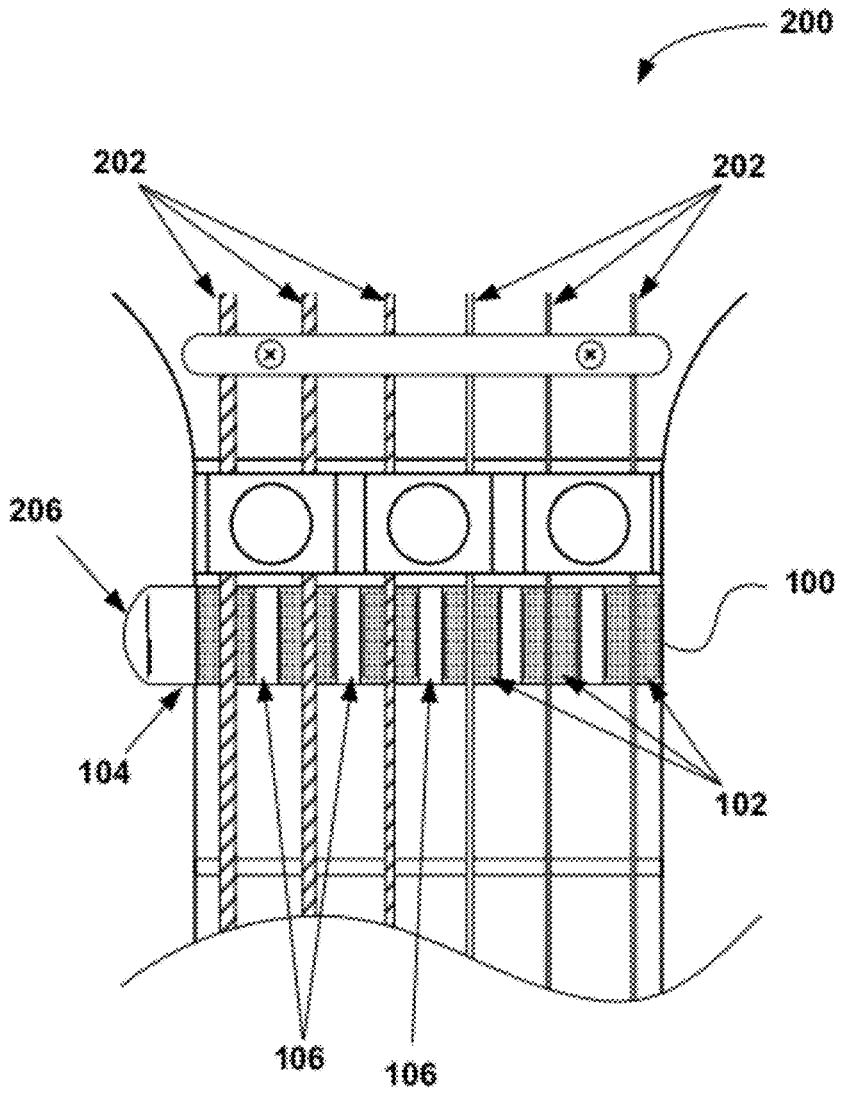
FIG. 2 is a diagram showing an exemplary dampening apparatus in use on the neck of a typical stringed musical instrument, in accordance with an embodiment of the present invention.

FIG. 2 is a diagram showing an exemplary dampening apparatus 100 in use on the neck of a typical stringed musical instrument 200, in accordance with an embodiment of the present invention. In the example of FIG. 2, the stringed musical instrument 200 is a six stringed guitar. As such, the exemplary dampening apparatus 100 of FIG. 2 includes six dampening pads 102, one for each string 202 of the guitar 200. However, as mentioned above, it should be noted that any number of dampening pads 102 may be included in embodiments of the present invention. As noted previously, the dampening pads 102 are configured on the base element 104 to allow for disengagement spaces 106 between the dampening pads 102.

In normal operation, the dampening apparatus 100 of the embodiments of the present invention is placed between the strings 202 and the fretboard and generally near the nut of the neck of the instrument 200. When engaged, as in FIG. 2, the disengagement spaces 106 are situated between the strings 202, while the strings 202 of the guitar 200 are disposed on top of the dampening pads 102, thus dampening the vibrations of the strings, as illustrated next with reference to FIG. 3.

Figure 3:
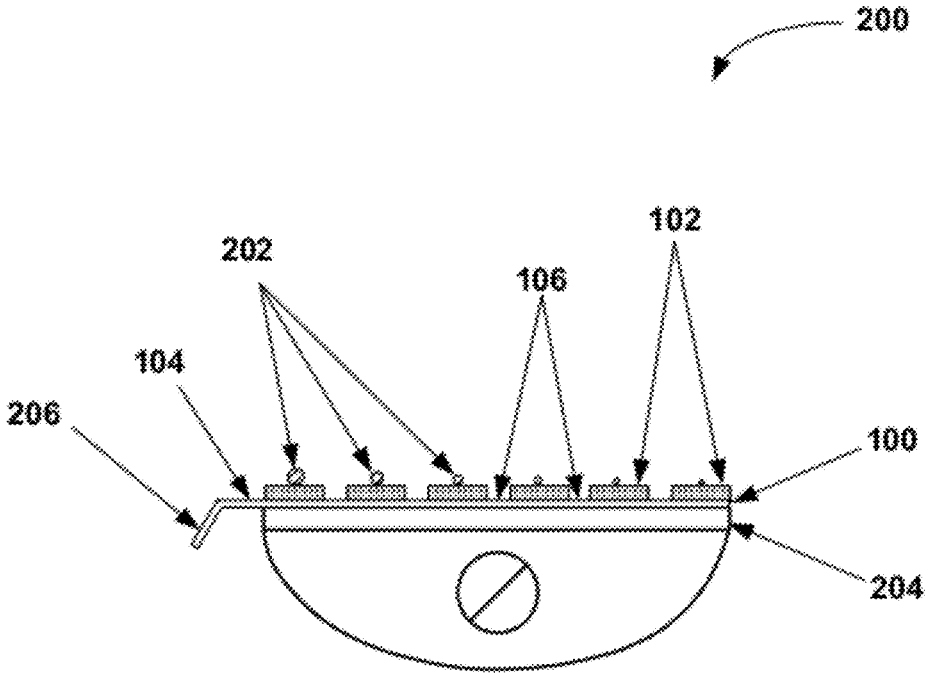
FIG. 3 is a side cutaway view showing the exemplary dampening apparatus of FIG. 2 in use on the neck of a typical stringed musical instrument, in accordance with an embodiment of the present invention.

FIG. 3 is a side cutaway view showing the exemplary dampening apparatus 100 of FIG. 2 in use on the neck of a typical stringed musical instrument 200, in accordance with an embodiment of the present invention. The dampening apparatus 100 includes a plurality of dampening pads 102 disposed on a base element 104, and configured to allow for disengagement spaces 106 between the dampening pads 102. As shown in FIG. 3, when engaged the disengagement spaces 106 are situated between the strings 202, while the strings 202 are disposed on top of, and in contact with, the dampening pads 102, thus dampening the vibrations of the strings. As discussed above, during operation the dampening apparatus 100 is placed between the strings 202 and the fretboard 204 and generally near the nut of the neck of the instrument 200.

When the strings 202 are disposed on top of, and in contact with, the dampening pads 102, unwanted extraneous noise caused by sympathetic vibrations in the strings 202 is effectively prevented. This effect should be distinguished from muting the strings completely, or from providing a capo type function. Moreover, because the dampening effect is achieved from below the strings, embodiments of the present invention allow utilization of all the notes from the entire neck of the instrument without changing the effectiveness of dampening. When dampening is no longer needed, the dampening apparatus 100 can easily be shifted to allow the strings 202 to vibrate freely via the disengagement spaces 106. To assist in shifting and to prevent over shifting of the dampening apparatus 100, one embodiment of the present invention includes a disengagement push tab 206, as illustrated next with reference to FIG. 4.

Figure 4:
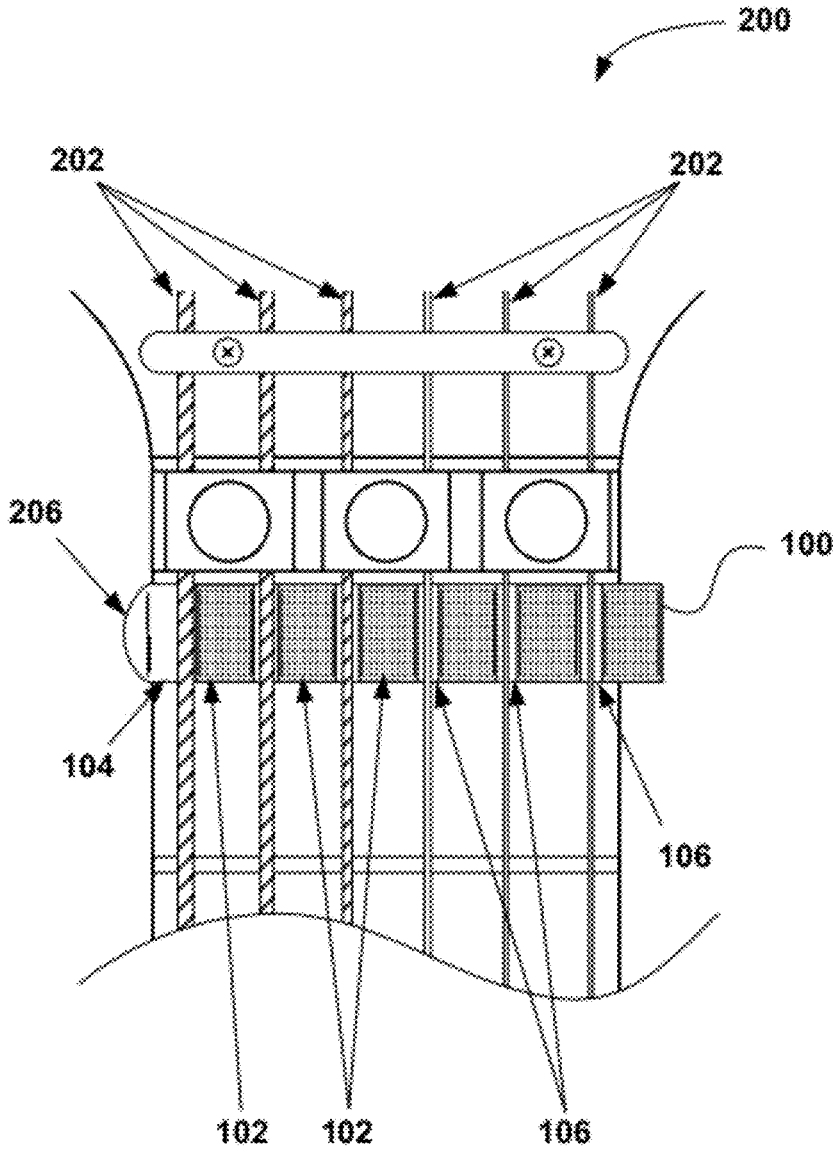
FIG. 4 is a diagram showing an exemplary dampening apparatus when disengaged on the neck of a typical stringed musical instrument, in accordance with an embodiment of the present invention.

FIG. 4 is a diagram showing an exemplary dampening apparatus 100 when disengaged on the neck of a typical stringed musical instrument 200, in accordance with an embodiment of the present invention. In the example of FIG. 4, the stringed musical instrument is a six stringed guitar. As such, the exemplary dampening apparatus 100 of FIG. 4 includes six dampening pads 102, one for each string 202 of the guitar 200. However, as mentioned above, it should be noted that any number of dampening pads 102 may be included in embodiments of the present invention.

The dampening pads 102 are configured on the base element 104 to allow for disengagement spaces 106 between the dampening pads 102. When disengaged, as in FIG. 4, the dampening pads 102 are situated between the strings 202, while the strings 202 of the guitar 200 are placed within the disengagement spaces 106, thus allowing the strings 202 to vibrate freely, as illustrated next with reference to FIG. 5.

Figure 5:
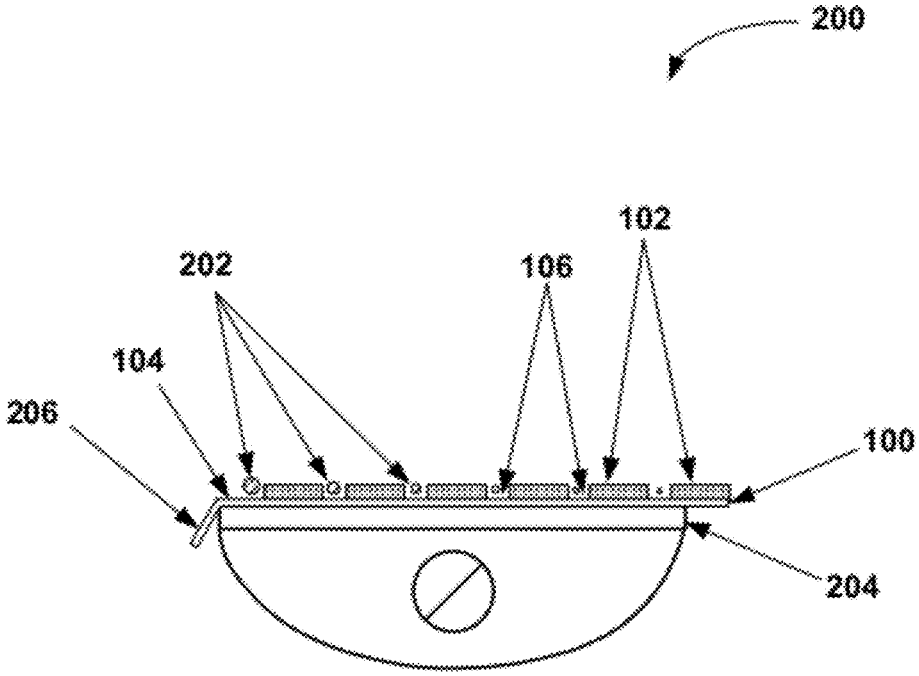
FIG. 5 is a side cutaway view showing the exemplary dampening apparatus of FIG. 4 when disengaged on the neck of a typical stringed musical instrument, in accordance with an embodiment of the present invention.

FIG. 5 is a side cutaway view showing the exemplary dampening apparatus 100 of FIG. 4 when disengaged on the neck of a typical stringed musical instrument 200, in accordance with an embodiment of the present invention. The dampening apparatus 100 includes a plurality of dampening pads 102 disposed on a base element 104, and configured to allow for disengagement spaces 106 between the dampening pads 102. As shown in FIG. 5, when disengaged the dampening pads 102 are situated between the strings 202, while the strings 202 of the guitar 200 are placed within the disengagement spaces 106, thus allowing the strings 202 to vibrate freely.

To assist in shifting and to prevent over shifting of the dampening apparatus 100, a disengagement push tab 206 can be included. The disengagement push tab 206 can be formed from a portion of the base element 104, or formed separately and attached to the base element 104, depending on the specific needs of a particular use of the embodiment. As shown in FIG. 5, the disengagement push tab 206 is configured to contact the fretboard 204 of the instrument 200 when the dampening apparatus 100 is properly aligned for disengagement. That is, when the strings 202 of the guitar 200 are placed properly within the disengagement spaces 106, allowing the strings to vibrate freely, the disengagement push tab 206 is in contact with the fretboard 204.

Figure 6:
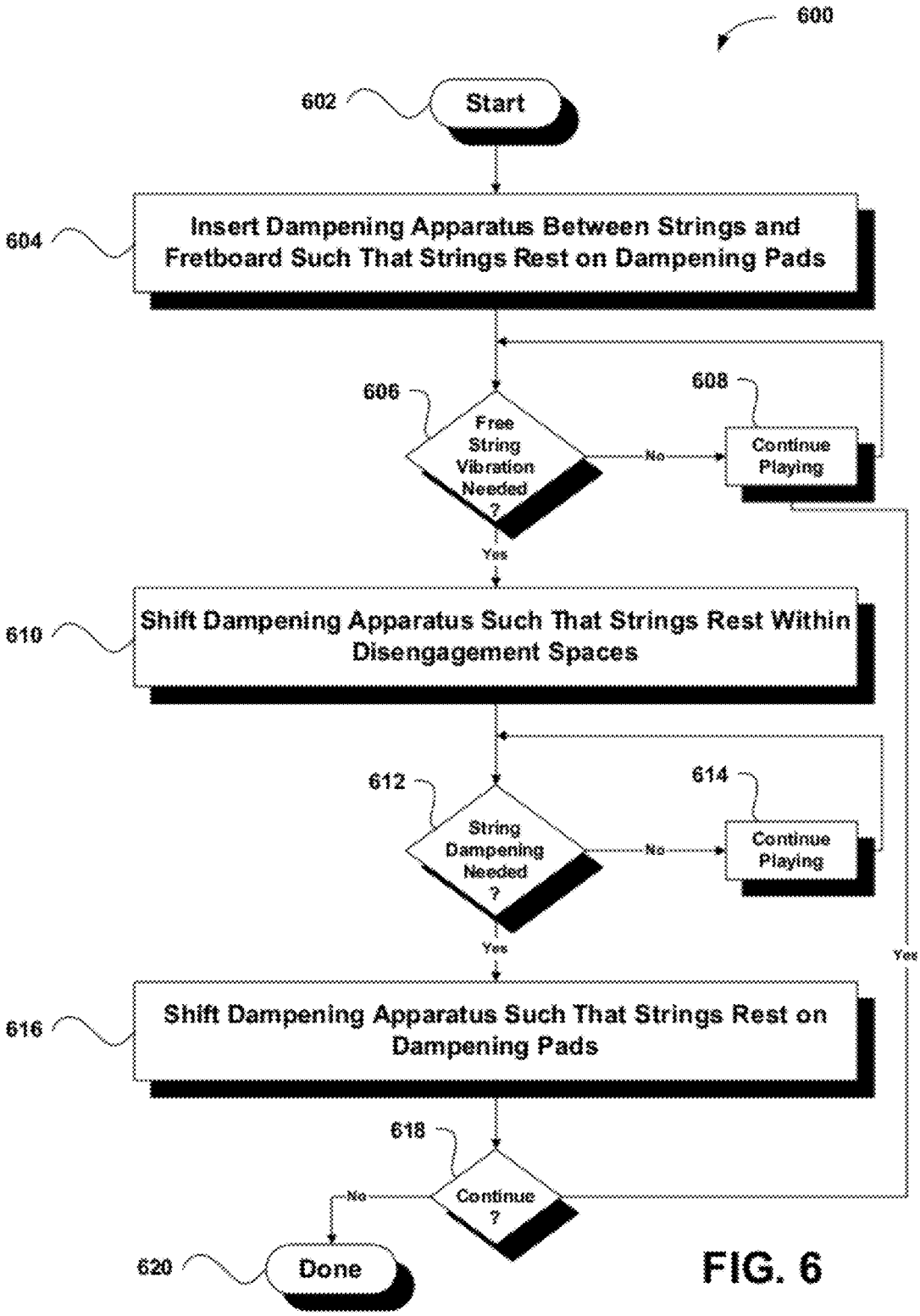
FIG. 6 is a flowchart showing a method for utilizing a dampening apparatus to engage and disengage the strings of a stringed instrument, in accordance with an embodiment of the present invention.

FIG. 6 is a flowchart showing a method 600 for utilizing a dampening apparatus to engage and disengage the strings of a stringed instrument, in accordance with an embodiment of the present invention. In an initial operation 602, preprocess operations are performed. Preprocess operations can include, for example, forming the dampening apparatus to conform to the particular musical instrument being used, tuning the musical instrument, and other preprocess operations that will be apparent to those skilled in the art after a careful reading of the present disclosure.

In operation 604, the dampening apparatus is inserted between the strings and the fretboard of the musical instrument such that the strings rest on the dampening pads. The dampening apparatus of the embodiments of the present invention generally is placed near the nut of the neck of the instrument. The pressure from the strings of the instrument hold the dampening apparatus in place, whether engaged or disengaged, thus providing an efficient and more cost effective alternative to prior art string dampeners, which generally are permanently attached to the instrument and fit over the strings, denying access to frets near the nut on the fretboard.

A decision is then made as to whether free string vibration is needed, in operation 606. When free string vibration is needed, the method 600 continues to operation 610. Otherwise, the method 600 branches to operation 608, where the musical instrument continues to be utilized with the dampening apparatus in the engaged position for continued string dampening.

In operation 610, the dampening apparatus is shifted such that the strings of the instrument rest within the disengagement spaces of the dampening apparatus. As mentioned above, the dampening apparatus includes a plurality of dampening pads disposed on a base element and configured to allow for disengagement spaces between the dampening pads. When disengaged, the dampening pads are situated between the strings, while the strings of the instrument are placed within the disengagement spaces, thus allowing the strings to vibrate freely.

To assist in shifting and to prevent over shifting of the dampening apparatus, a disengagement push tab can be included. The disengagement push tab can be formed from a portion of the base element, or formed separately and attached to the base element, depending on the specific needs of a particular use of the embodiment. The disengagement push tab is configured to contact the fretboard of the instrument when the dampening apparatus is properly aligned for disengagement. That is, when the strings of the guitar are placed properly within the disengagement spaces, allowing the strings to vibrate freely, the disengagement push tab is in contact with the fretboard.

A decision is then made as to whether string dampening is needed, in operation 612. When string dampening is needed, the method 600 continues to operation 616. Otherwise, the method 600 branches to operation 614, where the musical instrument continues to be utilized with the dampening apparatus in the disengaged position for free string vibration.

In operation 616, the dampening apparatus is shifted such that the strings rest on the dampening pads of the dampening apparatus. When engaged, the disengagement spaces are situated between the strings, while the strings of the instrument are disposed on top of the dampening pads, thus dampening the vibrations of the strings. As noted above, the pressure from the strings of the instrument hold the dampening apparatus in place, whether engaged or disengaged, thus providing an efficient and more cost effective alternative to prior art string dampeners, which generally are permanently attached to the instrument and fit over the strings, denying access to frets near the nut on the fretboard. In this manner, embodiments of the present invention advantageously allow utilization of all the notes from the entire neck of the instrument without changing the effectiveness of dampening because the dampening effect is achieved from below the strings.

Next, in operation 618, another decision is then made as to whether continued playing of the musical instrument is needed or desired. When continued playing of the musical instrument is needed or desired, the method 600 branches back to operation 608 where the musical instrument continues to be utilized with the dampening apparatus.

Otherwise, the method 600 ends in operation 620. Post process operations are performed in operation 620. Post process operation can include, for example, moving the dampening apparatus to a position near the first fret of the fretboard, removing the dampening apparatus from the musical instrument, and other post process operations that will be apparent to those skilled in the art after a careful reading of the present disclosure.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A dampening apparatus for a musical instrument, comprising:

a base element; and a plurality of dampening pads disposed on the base element and spaced to allow a string of a stringed musical instrument to fit between two dampening pads, and wherein dampening pads of the plurality of dampening pads are configured to fit between two strings of the stringed musical instrument, wherein the base element and the plurality of dampening pads are configured to fit between the strings and a fretboard of the stringed musical instrument without substantial damping effect.

2. A dampening apparatus as recited in claim 1, wherein the plurality of dampening pads engages strings of the stringed musical instrument when placed in a first position, wherein strings rest on the dampening pads when engaged.

3. A dampening apparatus as recited in claim 1, wherein the plurality of dampening pads disengage strings of the stringed musical instrument when placed in a second position, wherein strings rest between dampening pads when disengaged.

4. A dampening apparatus as recited in claim 1, wherein the dampening pads of the plurality of dampening pads are configured to dampen string vibrations.

5. A dampening apparatus as recited in claim 1, wherein the base element comprises a single strip of a soft plastic like substance.

6. A dampening apparatus as recited in claim 1, wherein each dampening pad comprises felt.

7. A dampening apparatus for a musical instrument, comprising:

a base element having a tab at one end; and a plurality of dampening pads disposed on the base element and spaced to allow a string of a stringed musical instrument to fit between two dampening pads, and wherein dampening pads of the plurality of dampening pads are configured to fit between two strings of the stringed musical instrument when the tab of the base element is positioned in contact with a fretboard of the stringed musical instrument, wherein the base element and the plurality of dampening pads are configured to fit between the strings and a fretboard of the stringed musical instrument without substantial damping effect.

8. A dampening apparatus as recited in claim 7, wherein the plurality of dampening pads engages strings of the stringed musical instrument when placed in a first position, wherein strings rest on the dampening pads when engaged.

9. A dampening apparatus as recited in claim 7, wherein the plurality of dampening pads disengage strings of the stringed musical instrument when placed in a second position, wherein strings rest between dampening pads when disengaged.

10. A dampening apparatus as recited in claim 7, wherein the dampening pads of the plurality of dampening pads are configured to dampen string vibrations.

11. A dampening apparatus as recited in claim 7, wherein the base element comprises a single strip of a soft plastic like substance.

12. A dampening apparatus as recited in claim 7, wherein each dampening pad comprises felt.

13. A method for dampening strings of a stringed musical instrument, comprising:

inserting a dampening apparatus between strings of a musical instrument and a fretboard of the musical instrument, the dampening apparatus having a plurality of dampening pads spaced to allow a string of a stringed musical instrument to fit between two dampening pads without substantial damping effect;

shifting the dampening apparatus such that each string rests within a space between two dampening pads of the dampening apparatus; and shifting the dampening apparatus such that each string rests on a separate dampening pad of the dampening apparatus.

14. A method as recited in claim 13, wherein the dampening pads of the plurality of dampening pads are configured to dampen string vibrations.

15. A method as recited in claim 13, wherein the base element comprises a single strip of a soft plastic like substance.

16. A method as recited in claim 13, wherein each dampening pad comprises felt.

* * * * *